US005797142A

United States Patent [19]

Debronsky, Jr. et al.

[11] Patent Number: 5,797,142

[45] Date of Patent: Aug. 25, 1998

[54] GOLF TOWEL ASSEMBLY

[75] Inventors: Nicholas Debronsky, Jr., 1309 Summit Oaks Dr., Burnsville, Minn. 55337; Kelly C. Robertson, Rosemount, Minn.

[73] Assignee: Nicholas Debronsky, Jr., Burnsville, Minn.

[21] Appl. No.: 787,275

[22] Filed: Jan. 24, 1997

[51] Int. Cl.[6] ..... A41D 27/00

[52] U.S. Cl. ..... 2/69; 2/1; 15/208; 15/209.1

[58] Field of Search ..... 2/69, 94, 102, 2/51, 50, 46, 48, 49.2, 49.4, 49.1, 1; 15/209.1, 208, 210.1

[56] References Cited

U.S. PATENT DOCUMENTS

| | | | |
|---|---|---|---|
| 2,754,532 | 7/1956 | Kanehl et al. . | |
| 3,760,461 | 9/1973 | Wright | 15/209.1 |
| 4,403,366 | 9/1983 | Lucke | 15/209.1 |
| 4,516,616 | 5/1985 | Fesler | 15/209.1 |
| 4,771,502 | 9/1988 | Trimble . | |
| 4,953,603 | 9/1990 | Holden | 15/209.1 |
| 5,012,543 | 5/1991 | Lewis, Sr. | 15/209.1 |
| 5,060,943 | 10/1991 | Stoffo . | |
| 5,075,918 | 12/1991 | Zeltner et al. | 15/210.1 |
| 5,143,371 | 9/1992 | Strahan . | |
| 5,147,703 | 9/1992 | Provost et al. . | |
| 5,244,278 | 9/1993 | Robitaille | 2/49.2 X |
| 5,286,019 | 2/1994 | Watabe . | |
| 5,326,610 | 7/1994 | Moss | 15/208 |
| 5,372,414 | 12/1994 | Lamonakis et al. . | |
| 5,394,914 | 3/1995 | Meek | 15/209.1 |

*Primary Examiner*—Gloria M. Hale
*Attorney, Agent, or Firm*—R. C. Baker & Associates, Ltd.

[57] ABSTRACT

The golf towel assembly comprises an upper portion for fastening to a golfer's front waist area and a depending lower portion for wiping debris from a golf ball. The lower portion is comprised of a layer of terry cloth having a length between about 15 and 25 centimeters, a width between about 10 and 20 centimeters, and surface area between about 150 and 425 square centimeters. The lower portion has a shape sufficient to accommodate a circle of at least about 10-centimeter diameter so as to permit easy wrapping of the lower portion about a golf ball for cleaning. A major portion of the lower portion can be unobtrusively stowed in the front pants pocket of a golfer to keep the lower portion from interfering with the golfer's swing and yet can be quickly removed to clean a golf ball for putting while the towel assembly is attached to the golfer's front waist area. The ideal shape for the towel assembly is triangular and it is ideally equipped with a golf ball pocket. Kit packages and a method of use are provided.

32 Claims, 4 Drawing Sheets

GOLF TOWEL ASSEMBLY

BACKGROUND OF THE INVENTION

This invention relates to a golf towel assembly, and particularly to a golf towel assembly that easily attaches to a golfer's front waist area for stowing of a major portion in the golfer's front pants pocket and thus out of interference with the golfer's swing while also providing quick access to the towel when needed for cleaning a golf ball. The invention also relates to a golfer equipped with the new golf towel assembly, and to a method for cleaning a golf ball, especially for putting. Further, the invention relates to various packages or kits of the new golf towel assembly with golf ball slips.

Golf—especially putting—is a game of precision. Among golfers, a common phrase is "Drive for show, putt for dough," since putting can have a dramatic effect on a golf score. It follows that golfers are extremely sensitive regarding the conditions for putting. Among the conditions that a golfer can control is ensuring that the golf ball is free of debris so it rolls as true as possible when struck by a putter. According to the rules of golf, a golfer may not play one golf ball from tee to green, then putt with a different ball, unless the golf ball has become unfit for play. A ball is not unfit for play "solely because mud or other materials adhere to it" (Rule 5-3 of USGA Rules of Golf). Further, a golf ball must be played as it lies (USGA Rule 13-1), but an exception to this rule is for putting. Once a golf ball comes to rest on the putting green, the ball may be lifted and cleaned (USGA Rule 16-1b). On the putting green, however, no special equipment or provisions are provided for cleaning a golf ball. Most golf courses provide golf ball washers in the tee area for cleaning a golf ball prior to hitting a tee shot, but on the putting green, a golfer must provide his own means for cleaning his golf ball prior to putting.

A common practice is to attach a towel to the golfer's golf bag or golf cart. A golf bag or golf cart, however, may not be taken onto the putting green by the golfer. Carrying a ball off the green to the golf bag or cart for cleaning purposes is too time consuming. Thus, towels of the type commonly attached to a golf bag or cart, if taken on the green, must be detached from their attachment, carried onto the green by the golfer to clean the golf ball, then in all likelihood placed on the green's surface while putting, picked up off of the green when putting is finished, and then re-attached to the golf bag or cart. The drawbacks with this process are many. Whenever the towel is detached from an attachment, it can be very easily misplaced or forgotten on the green, only to be remembered when the golfer reaches the next tee or green and is in need of the towel for cleaning the golf ball. A common frustration for golfers is slow play. The process of detaching the towel, laying it down and picking it up off a green multiple times, and re-attaching it to the golf bag at each of 18 holes can add significant time to a round of golf. This is especially problematic when the golfer leaves his bag by the side of the green and proceeds onto the green to line up his putt shot, then realizes that the towel is still attached to the golf bag. Moreover, towels of the type for attaching to a golf bag are usually large, multipurpose towels, intended for use in wiping a golfer's hands, cleaning a golf club head or grip, as well as cleaning a golf ball, so they are not easily carried as an unattached item about the golf course.

Accordingly, there is a need for a new type of golf towel that can be always readily available for a golfer's use to clean a golf ball, especially on a putting green, and can nevertheless be quickly and easily stowable so as not to interfere with the golfer's swing. There is also need for a new and unusual method for preparing a golfer for cleaning a golf ball on a putting green. Additionally, there is a need for an approach to packaging the new golf towel in a manner that will satisfy manufacturers and also be attractive and alerting and readily acceptable to golfers, without significantly adding to the bulk of the equipment golfers purchase and use. Still further, there is need to satisfy the thirst of advertisers for new and innovative ways to promote products to golfers and golf spectators. It is to a solution of these needs that this invention is directed.

SUMMARY OF THE INVENTION

The golf towel assembly of the invention is for attachment to a golfer's front waist area to assure that it is not misplaced on the golf course and is always readily available for cleaning a golf ball when required by the golfer. Further, it is of a size to permit easy stowage in the golfer's front pants pocket so it does not interfere with the golfer's swing or other movements about the golf course. The golf towel assembly comprises an upper portion for fastening to a golfer's front waist area and a depending lower portion for wiping debris from a golf ball. At least the lower portion is comprised essentially of a layer of terry cloth. The lower portion has a length and width and surface area. The length of the lower portion in the direction depending from the upper portion is at least about 15 centimeters and not more than about 25 centimeters. The width in the direction transverse to the length is at least about 10 centimeters and not more than about 20 centimeters. The surface area is at least about 150 square centimeters and not more than about 425 square centimeters. The surface area is also of a shape sufficient to accommodate the area embraced by a circle having a diameter of at least about 10 centimeters so as to permit easy wrapping of the lower portion about a golf ball for cleaning. The length and width and surface area are such that at least a major portion of the lower portion is easily stowed in a front pants pocket of a golfer to keep the depending lower portion from interfering the golfer's swing and yet is quickly removable from the golfer's front pants pocket to permit use of the lower portion to clean a golf ball preliminary to putting while at all times retaining the golf towel assembly attached at its upper portion to the golfer's front waist area.

The invention includes multiple embodiments of the golf towel assembly, including those having a golf ball pocket, those having a triangular-shaped golf towel assembly, those having various ways of attaching the golf towel assembly to a golfer's front waist area as well as those that have a panel for providing visual promotional information. The invention also incorporates the combination of a golfer equipped with the new golf towel assembly. Further, the invention includes various novel ways of packaging the new golf towel assembly with golf ball slip packages.

The method of the invention for preparing a golfer for cleaning a golf ball for putting comprises the steps of equipping the golfer with pants having a waist band and a front pants pocket, providing the golfer with the new golf towel assembly, fastening the upper portion of the towel assembly to the golfer's waist band, tucking the lower portion in the golfer's front pants pocket to keep the towel from interfering with the golfer's swing and to allow quick removal of the lower portion for cleaning the golf ball, and removing the lower portion from the golfer's front pants pocket to clean the golf ball while retaining the upper portion fastened to the golfer's waist band.

Still other benefits, advantages, and novel features of the invention will be evident as this description proceeds.

DESCRIPTION OF THE PREFERRED EMBODIMENT(S)

Figure 1:
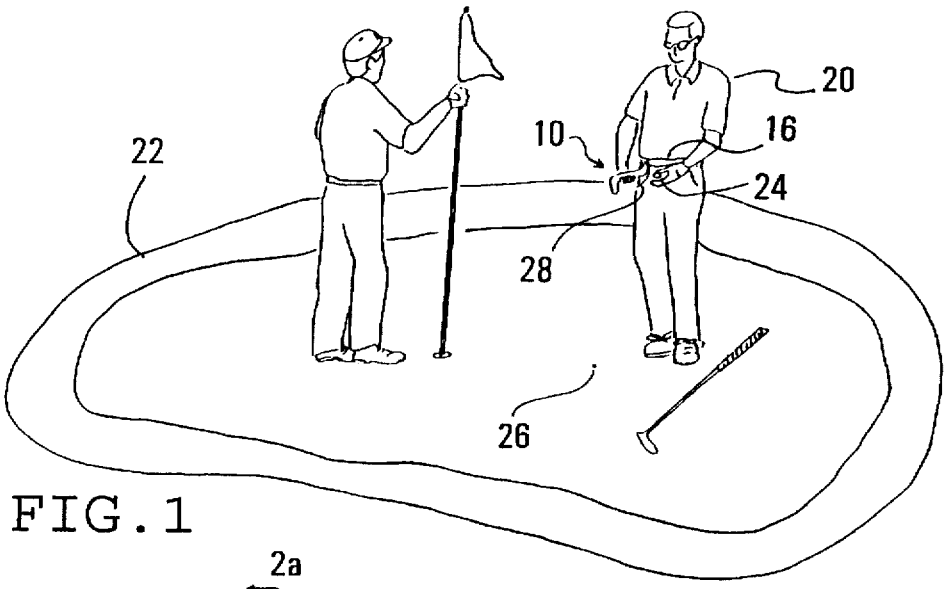
FIG. 1 is a schematic perspective view of a golfer using the golf towel assembly on a green prior to putting.

In all views of the drawing, the same number is used for common elements or functionally similar elements. For example, the upper portion of the golf towel assembly is always given the number 12, whereas the lower portion is always given the number 14. The overall golf towel assembly is always given the numeral 10. Keeping this in mind, the upper portion 12 of the golf towel assembly is for fastening to a golfer's front waist area 18. Depending from that upper portion 12 is a lower portion 14 for wiping debris from a golf ball. The lower portion 14 is considered to be the portion of the assembly 10 that depends from the upper portion 12 (which upper portion serves as the part of the assembly that attaches to the golfer's front waist area). At least the lower portion 14 is comprised essentially of a layer of terry cloth, which is a popular, well-known towel cloth.

In FIG. 1, the golf towel assembly 10 is shown attached to a belt 16 at the front waist area of a golfer 20 who is situated on a putting green 22. In preparation for a putt shot, the golfer 20 has marked the location of his golf ball on the green with a ball marker 26, and has picked up his golf ball from the putting green 22. The golfer 20 is using the lower portion of the golf towel assembly 10 to clean debris from his golf ball 24 while leaving the upper portion of the golf towel assembly fastened to his belt 16. The lower portion of the golf towel assembly or a portion of it may be wetted or dampened or moistened for better cleaning of debris from the golf ball 24. Prior to putting, the golfer 20 will place a major part of the lower portion of the golf towel assembly 10 in his front pants pocket 28 to prevent it from interfering with his putt shot and subsequent shots on the golf course.

Figure 2:
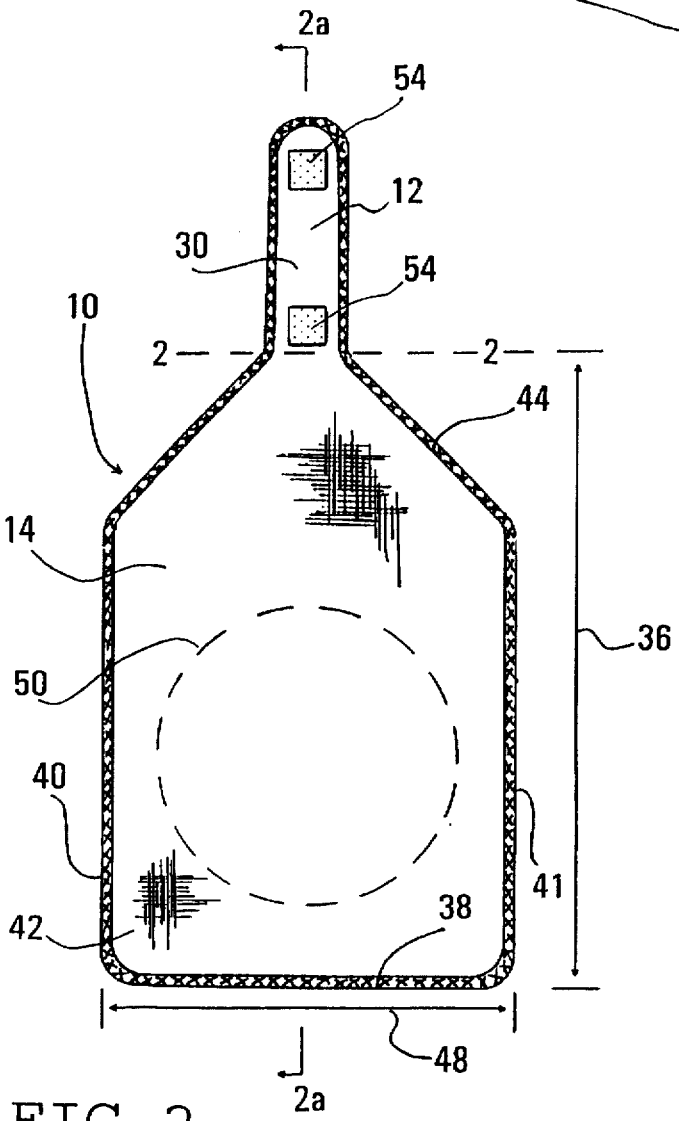
FIG. 2 is a front elevation view of an embodiment of the golf towel assembly with mating VELCRO brand fastener elements.
Figure 5:
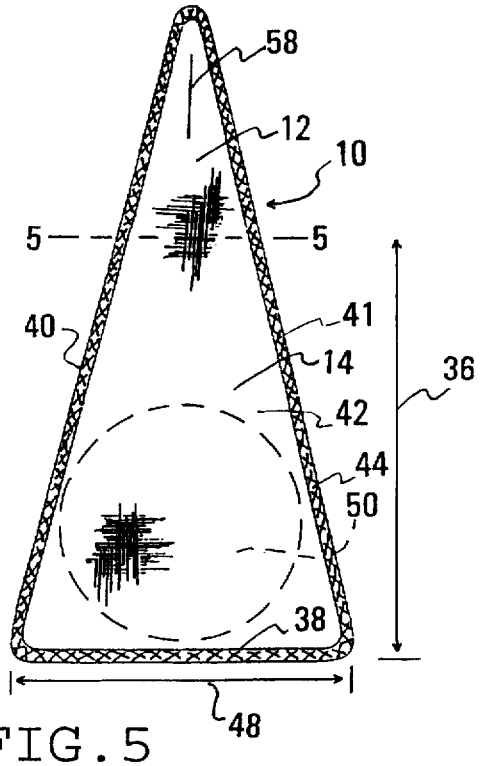
FIG. 5 is a front elevation view of a triangular shaped embodiment of the golf towel assembly with integral upper and lower portions.
Figure 6A:
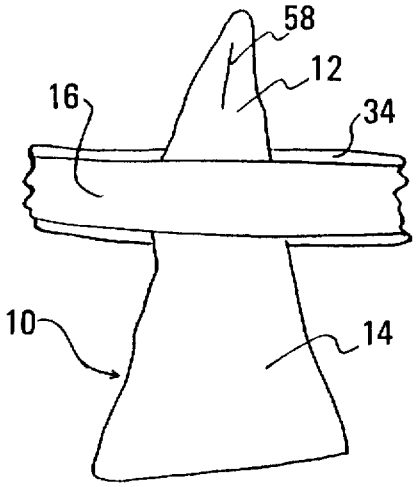
FIGS. 6*a* through 6*d* are a sequence of schematic front perspective views illustrating a method of fastening the triangular golf towel assembly about a belt.
Figure 6B:
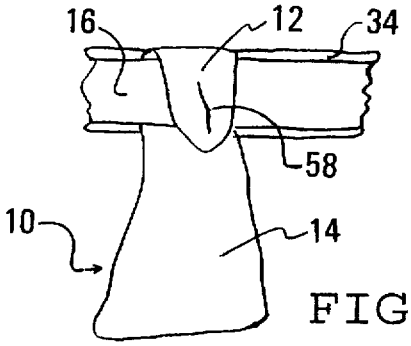
Figure 6C:
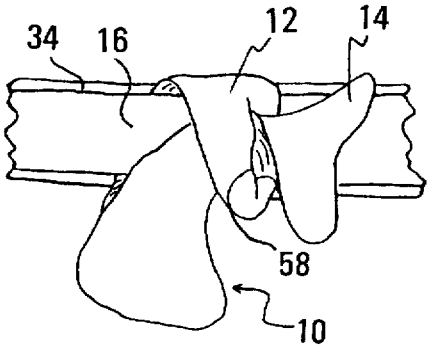
Figure 6D:
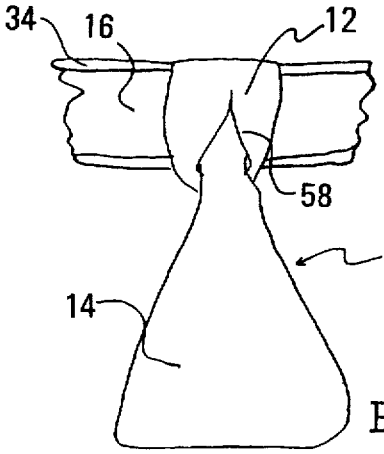

The lower portion 14 of all embodiments of the golf towel assembly is characterized as having a length 36 and a width 48 and a surface area of an overall size defined by the contour of its lateral edges 40, 41 and its base edge 48 (see particularly FIGS. 2 and 5). The top edge for the lower portion 14 is just below the part 12 for securing the composite golf towel assembly at the waist of a golfer. In the case of the towel assembly of FIG. 2, the top edge of the lower portion 14 is at dash line 2—2, which line is just below the lowermost hook or loop element 54 (e.g., VELCRO brand fastener element) shown in FIG. 2, whereas in the case of the towel assembly illustrated in FIG. 5, the top edge of the lower portion 14 is at the dash line 5—5 in FIG. 5. That dash line 5—5 is at the location on the triangular golf towel assembly that lies at the lower edge of a golfer's belt line (i.e., waist) after the triangular golf towel assembly (with its slot fixing means 58) is attached in the manner illustrated in the sequence of figures comprising FIG. 6.

What is important is that the length 36 of the lower portion 14 of the composite golf towel assembly 10 is in a direction that depends from the upper portion 12 of the assembly. This length 36 is at least about 15 centimeters long and not more than about 25 centimeters long. It is critical that this length be limited within the noted range. Such a length permits a major part of the lower portion of the assembly to be conveniently stowed within a front pants pocket of a golfer and thus stowed away from interference with the golfer's swing. The part of the lower portion 14 extending between the upper edge of it and the part stowed in the golfer's pocket must in essence lie in flush condition against the front pants area of the golfer.

The lowermost edge 38 of the lower portion 14 of the composite golf towel assembly plays an important part in contributing to retention of the major portion (i.e., over 50 percent) of the total area of the lower portion 14 within the front pants pocket of a golfer while the upper portion 12 is affixed at the waist area of the golfer. A significant contribution of the base edge 38 to retention within the golfer's front pants pocket is that of providing sufficient width at the lowermost portion of that edge 38 so as to give that portion a body or bulk for retention within the golfer's front pants pocket. To be noted is that the base edge 38 in the illustrated embodiments is generally parallel to the golfer's waist band 34. Put another way, the lower edge 38 extends in a direction perpendicular to the lengthwise direction of the lower portion of the composite assembly. It is body of material at the base edge 38 that contributes to ease of retention of a major area of the lower portion 14 within the golfer's front pants pocket even though a part of that lower portion may and does extend upwardly from the opening of the golfer's pants pocket to the line of separation between the upper and lower portions of the composite towel assembly.

The width 48 for the lower portion 14 may vary depending on the contour of the lateral edges 40, 41. For the most part, the lateral edges are either parallel as illustrated in FIG. 2 or are tapered as in the case of the triangular shape for the composite towel assembly illustrated in FIG. 5. The width should be at its maximum at the base edge 38. Always the width is in the direction transverse to the length direction for the lower portion and is, at its maximum, at least about 10 centimeters (or not less than about 10 cm.) and never more than about 20 centimeters. Greater widths create too much bulk for convenience of handling in the manner illustrated and required for the new towel assembly.

The lower portion of the towel assemblies of the invention has a surface area bounded by the outer limits of the upper edge (e.g., dash line 2—2 in FIG. 2), lower or base edge 38, and lateral edges 40, 41 of the lower portion. The surface area should be at least about 150 square centimeters but never more than about 425 square centimeters. This surface area has to be of a shape sufficient to accommodate a circle having a diameter of about 10 centimeters so as to permit easy wrapping of the lower portion about a golf ball for cleaning. The circle of a diameter of at least about 10 centimeters is illustrated in FIGS. 2 and 5 by a dash line 50.

In the embodiment of FIG. 2, the upper portion 12 of the composite assembly comprises a narrow, rectangularly shaped strip of material 30 that extends up from the lower portion 14. The lower portion 14, while generally rectangularly shaped, may be tapered to form the junction with the upper strip portion 12. In the triangular shaped embodiment of the golf towel assembly as shown in FIG. 5, the upper portion 12 is integral with the lower portion 14, with a phantom dash line 5—5 defining the approximate operable boundary between the upper portion 12 and lower portion 14. The length of the lower portion 14 (from the golfer's waist band 34) is illustrated by the vertical line marked 36 to the right in FIG. 5. The triangular shaped golf towel assembly 10 has two lateral side edges 40, 41 and a base edge 38 that is generally parallel to the golfer's waist band 34.

Figure 2A:
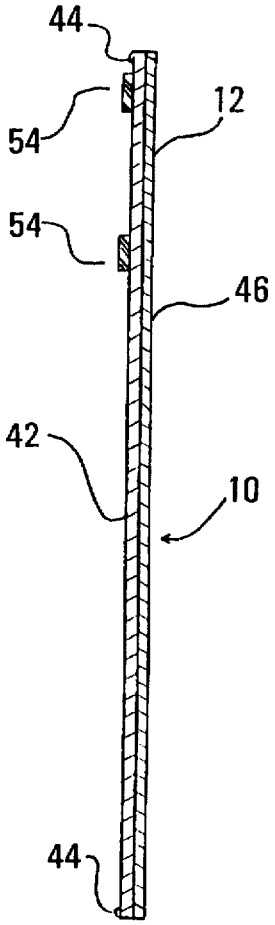
FIG. 2*a* is a cross-section view taken on line 2*a*—2*a* of FIG. 2, illustrating a water impermeable film backing on the golf towel assembly.

At least the lower portion 14 of the golf towel assembly 10 is comprised of a sheet or layer of absorbent towel material 42. The material may have stitching or a seam 44 around the perimeter to prevent the towel material 42 from unraveling. Terry cloth is the preferred material since it is sufficiently absorbent and durable to clean debris (especially moistened debris) from a golf ball, yet it is pliable enough to easily fit in a front pants pocket for stowage. Specifically, terry cloth having a cotton content of at least 50 percent by weight (with any optimal synthetic fiber content not over 50 percent by weight), and having a light weight within the range of about 0.02 to about 0.05 grams per square centimeter (ideally about 0.03 grams per square centimeter), has been found to possess the best balance of properties required for the lower portion 14. To prevent moisture from coming in contact with the golfer's pants, the lower portion 14 may comprise a laminate having a water-impermeable barrier film or coating 46 in addition to the layer of terry cloth 42 (see FIG. 2*a*).

It is imperative that at least a major portion (i.e. over 50% of the area) of the lower portion 14 can be securely stowed in the golfer's front pants pocket 28 to prevent the towel from interfering with the golfer's swing, yet the lower portion 14 must be easily accessible so the towel material 42 can be quickly available for cleaning a golf ball when necessary. Thus, the length 36 of the lower portion 14 that depends from the golfer's waist band 34 is critical. The lower portion must hang down from the upper portion 12 and also remain securely stowed or tucked in the golfer's front pants pocket 28 while the composite towel assembly is fastened at its upper portion to the golfer's front waist area 18. The horizontal base edge 38 is significant in contributing to this result and that significance is even greater for the triangular shaped embodiment of FIG. 5. That triangular embodiment has side edges 40, 41 that extend from the top apex of the upper portion 12 to the base edge 38. These lateral sides 40, 41 have a slant length between about 25 centimeters and about 40 centimeters.

Figure 3:
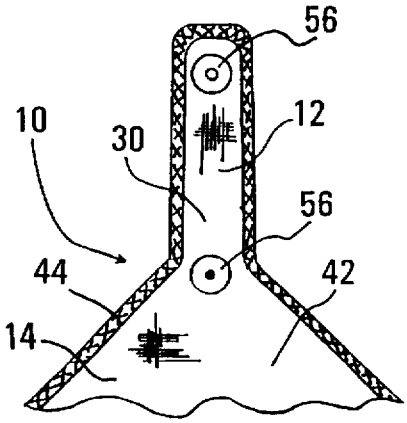
FIG. 3 is a fragmentary front elevation view of the golf towel assembly with mating snap fastener elements.
Figure 4:
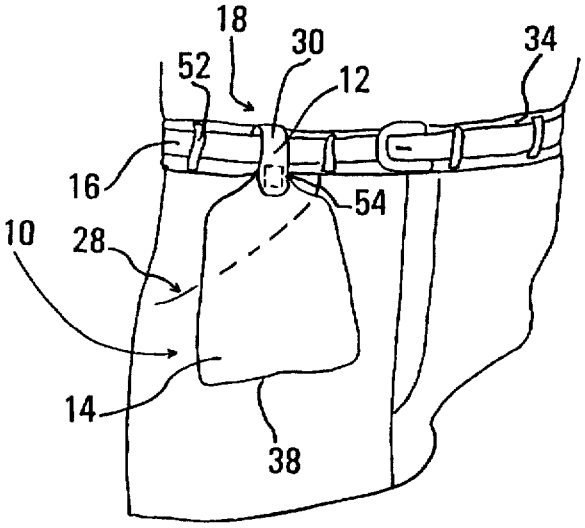
FIG. 4 is a perspective view of the golf towel assembly fastened to a waist belt.

The upper portion 12 of the golf towel assembly 10 can be fastened to a golfer's belt 16, belt loop 52 or waist band 34 by a variety of fastening means. Referring specifically to FIG. 2, hook and loop fastener elements 54 are mounted on the upper portion 12 in spaced relationship. The hook and loop fastener elements 54 suitably may be common Velcro fasteners. Alternatively, spaced cooperatively mated male and female snap fastener elements 56 may be mounted on the upper portion 12 (see FIG. 3). One method of fastening the upper portion 12 to the golfer's front waist area 18 is illustrated in FIG. 4, wherein the upper portion 12 is in a substantially surrounding condition about a removable belt 16 located around the golfer's waist band 34, with the cooperative VELCRO brand fasteners 54 securing the upper portion 12 around the golfer's belt 16.

Figure 7:
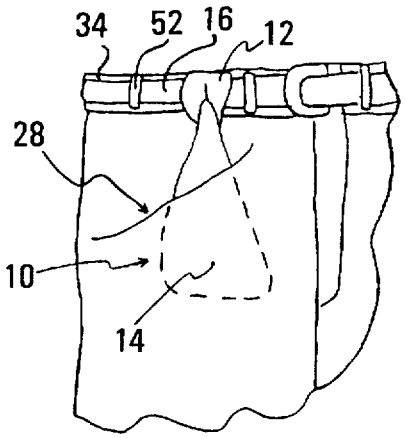
FIG. 7 is a front perspective view of the triangular golf towel assembly fastened about a belt and stowed in a front pants pocket.

Refer now specifically to FIGS. 5 through 7, inclusive, for an alternative embodiment for the golf towel assembly 10 and method for attaching the upper portion 12 of it to a golfer's front waist area 18. The upper portion 12 has a slit 58 extending therethrough. The slit 58 is between about 2 centimeters and about 6 centimeters (preferably between 3 and 5 centimeters) in length and preferably extends in a direction perpendicular to the base edge 38 and perpendicular to the lateral width of the towel assembly but parallel to the length of the lower portion 14. It is through this slit 58 that the lower portion 14 is threaded. As illustrated in FIGS. 6*a* through 6*d*, the upper portion 12 is placed between the removable belt 16 and the golfer's waist band 34 (FIG. 6*a*) and essentially looped about the belt 16 such that the upper portion 12 substantially surrounds the belt 16 (FIG. 6*b*). The lower portion 14 is tucked into slit 58 (FIG. 6*c*) and threaded therethrough, so that the upper portion 12 is fastened about the belt 16 and the lower portion 14 depends therefrom (FIG. 6*d*). Finally, the lower portion 14 is stowed in the golfer's front pants pocket 28 (FIG. 7) until it is required by the golfer for cleaning a golf ball.

Figure 2B:
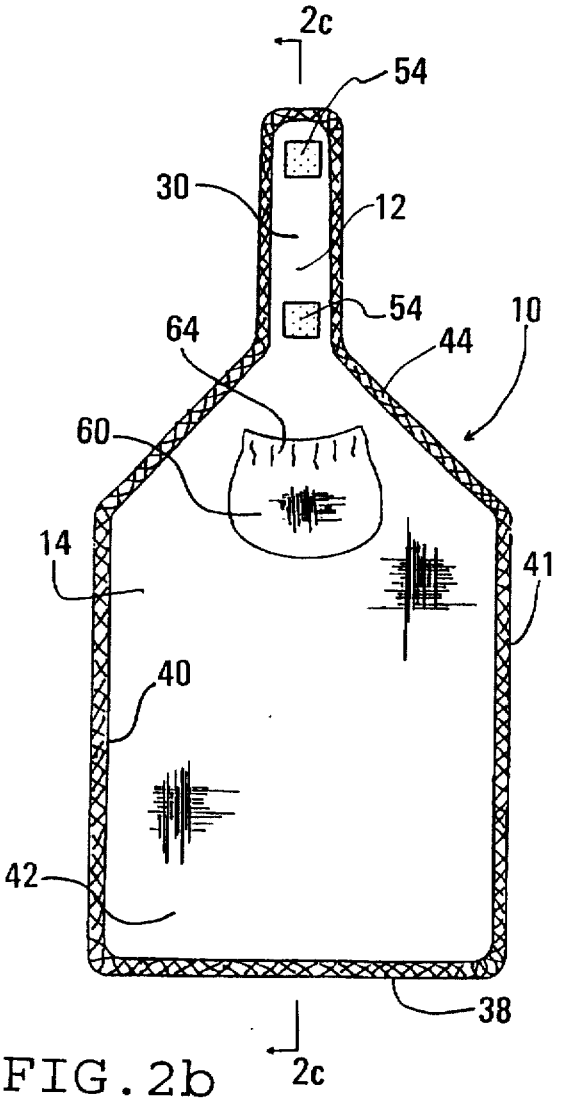
FIG. 2*b* is a front elevation view of an embodiment of the golf towel assembly having an optional pocket for a golf ball.
Figure 2C:
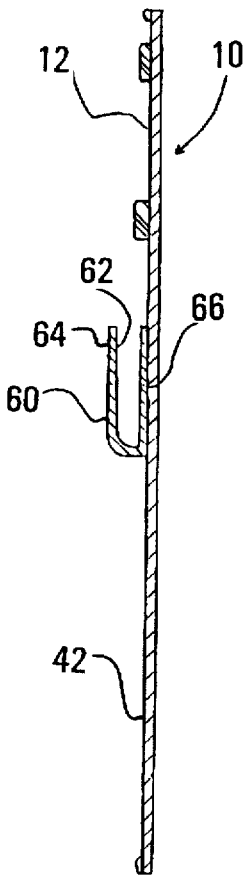
FIG. 2*c* is a cross-section view taken on line 2*c*—2*c* of FIG. 2*b*, showing a moisture shield or barrier on the surface of the lower portion of the golf towel assembly at a location within the golf ball pocket.
Figure 2D:
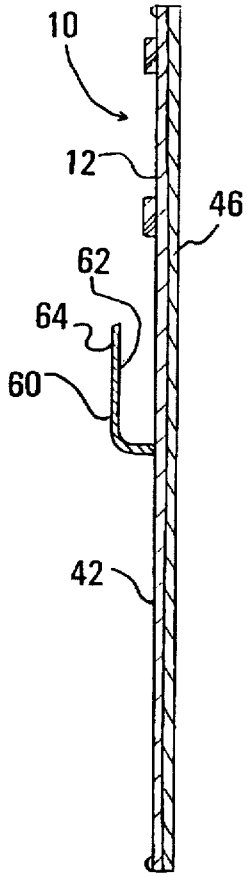
FIG. 2*d* is an alternative side cross-section view taken on line 2*c*—2*c* of FIG. 2*b*, showing a water-impermeable backing at the pocket area (and indeed all areas) of the golf towel assembly.

In FIGS. 2*b* through 2*d*, a golf ball pocket 60 is shown on the lower portion 14, useful to hold a golf ball. The golf ball pocket 60 suitably has a gathered elasticized mouth edge 64 (extending in the width direction of the lower portion 14) for preventing a golf ball from inadvertently falling out of it. The inside 62 of the golf ball pocket 60 may be provided with a fabric or sponge (either loose or fastened to an inside surface) capable of being moistened or wetted (e.g., using golfer's spit or saliva, if desired) to assist the golfer in cleaning a golf ball of debris. The pocket preferably is lined with a layer impervious to moisture or at least resistant to moisture penetration. Thus, the inside of the pocket (especially the part along towel material 42) may be provided with a moisture barrier or a water-impermeable film or sheet or layer 66 (e.g., of any suitable plastic including a Teflon film called Tetra Teck from the Donaldson Co. of Minnesota) to keep pocket moisture from contacting the golfer's pants. Optionally, the entire lower portion 14 may be a laminate having a water-impermeable backing film 46 on the towel layer 42 (see FIG. 2*d*).

Figure 8:
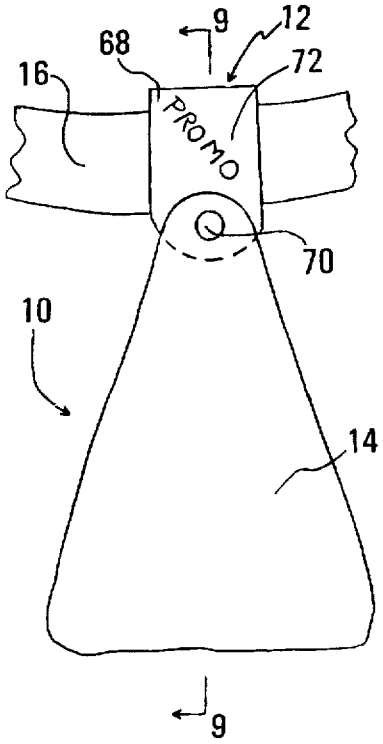
FIG. 8 is a front elevation view of an embodiment of the golf towel assembly having an upper portion comprising a clip equipped with a promotional panel.
Figure 9:
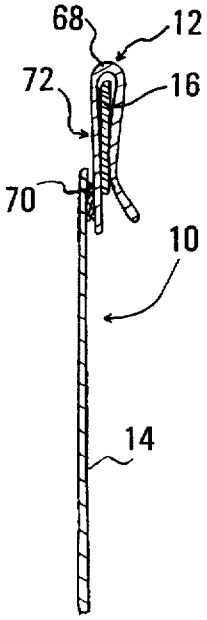
FIG. 9 is a schematic sectional view taken on line 9—9 of FIG. 8.

Yet another embodiment of the golf towel assembly 10 is illustrated in FIGS. 8 and 9. In this embodiment, the upper portion 12 comprises a clip 68 for attaching to a removable belt 16 or a waist band. The clip 68 and the lower portion 14 each have cooperative fastener elements 70 mounted thereon for securing the lower portion 14 to the clip 68. Common snap fastener elements or VELCRO brand fastener elements may be used in this embodiment. A significant feature of the upper portion 12 of the embodiment portrayed in FIGS. 8 and 9 is a panel area 72 for providing visual promotion information.

Figure 11:
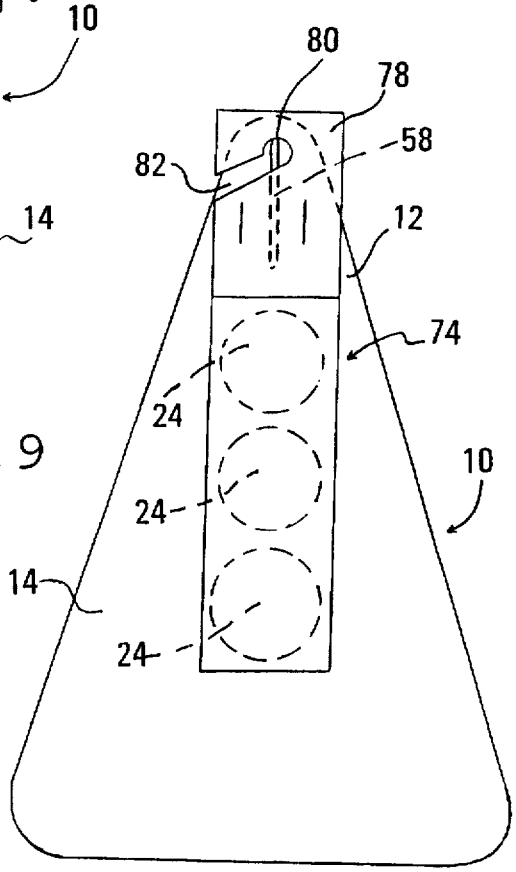
FIG. 11 is a schematic front elevation view of a golf towel assembly and a golf ball slip pack attached to a hanger sheet hung on a display rack hook.
Figure 10:
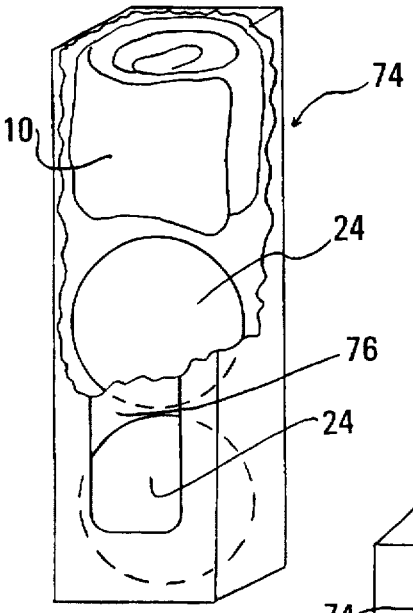
FIG. 10 is a schematic perspective view, partially broken away, illustrating a golf towel assembly in rolled up condition inside of a golf ball slip package.
Figure 12:
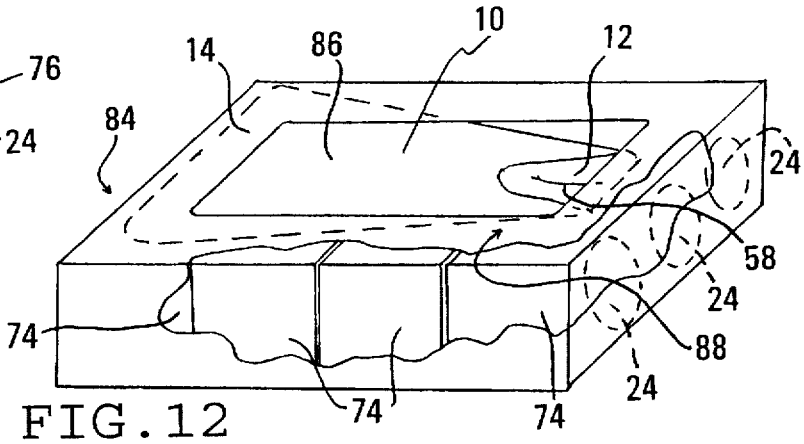
FIG. 12 is a schematic front perspective view, partially broken away, of the golf towel assembly in folded condition within a package or kit containing four golf ball slip packs.

Turning now to FIGS. 10 through 12, various novel packaging kits of the invention will be discussed. Golf balls are typically sold in oblong slip packages 74 holding three golf balls 24. The golf b all slips 74 of this invention may be of the type constructed of paper board material, and the slips 74 should have a transparent window 76 to permit a consumer to view the contents of the slip 74. Packaging the golf towel assembly 10 along with golf balls 24 helps ensure that golfers have access to the golf towel assembly 10 for cleaning golf balls 24 prior to putting on each round of golf. FIG. 10 shows a kit comprising a slip 74 holding two golf balls 24 along with the golf towel assembly 10 in a folded and rolled configuration. In FIG. 11, a slip 74 containing three golf balls 24 has a hanger sheet 78 of plastic or paper extending therefrom for receiving a display rack hook 80. The golf towel assembly 10 is stapled to the hanger sheet 78. The hanger sheet 78 has an opening 82 therethrough, and the slit 58 through the upper portion 12 of the illustrated golf towel assembly 10 is aligned with the opening 82 to permit a display rack hook 80 of the type normally found on a retail display rack to extend through both the opening 82 and the slit 58. Yet another kit is illustrated in FIG. 12. Four slips 74 containing three golf balls 24 each are packaged in a side by side configuration within a paperboard outer container 84. The outer container 84 may have a transparent window 86 for viewing the contents within it. The slips 74 in the side by side configuration form a substantially flat surface 88, and the golf towel assembly 10 is spread out over the substantially flat surface 88. The golf towel assembly 10 may be folded (e.g., with the upper portion folded to extend over the lower portion) within the outer container 84. By combining the golf towel assembly 10 with packages of golf balls 24, these various novel packaging kits alert a golfer to get and use the golf towel assembly 10 for cleaning golf balls 24 prior to putting.

Golfers have high putting expectations and will find the golf towel assembly and the method of cleaning a golf ball according to the teachings of this invention to be indispensable. The invention not only provides a convenient, unobtrusive and truly portable means for cleaning a golf ball on a green prior to putting, but also provides golf ball packages totally departing from the conventional in that they include a component, namely a golf towel assembly, never before thought of as being available to package with golf balls.

It is to be expected that those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. A golf towel assembly for attachment to a golfer's front waist area for cleaning a golf ball, said golf towel assembly comprising:

an upper portion for attachment to a golfer's front waist area and a depending lower portion for wiping debris from a golf ball, at least said lower portion being comprised essentially of a layer of terry cloth, said lower portion having a length and width and surface area and a base edge, said length being in the direction depending from said upper portion and being at least about 15 centimeters and not more than about 25 centimeters, said width being in the direction transverse to said length and being at least about 10 centimeters and not more than about 20 centimeters, said surface area being at least about 150 square centimeters and not more than about 425 square centimeters and being of a shape sufficient to accommodate a circle having a diameter of at least about 10 centimeters so as to permit easy wrapping of said lower portion about a golf ball for cleaning, and said base edge being at the end of said lower portion most distant from said upper portion and extending as a straight edge substantially perpendicular to said length and substantially parallel to said width and being at least as wide as the widest part of said width, said length and width and surface area and base edge being such that at least the major bulk portion of said lower portion is most distant from said upper portion and proximate to said base edge and is easily stowed and retained in a stowed condition in a front pants pocket of a golfer to keep said depending lower portion from interfering with the golfer's swing and yet is quickly removed from the golfer's front pants pocket to permit use of said lower portion to clean a golf ball preliminary to putting while at all times retaining said golf towel assembly attached at its upper portion to the golfer's front waist area.

2. The assembly of claim 1 wherein said upper portion comprises a strip of material extending from said lower portion, said strip of material having cooperative fastener parts mounted thereon in spaced relationship for attaching said upper portion about a belt or a belt loop.

3. The assembly of claim 1 wherein said lower portion is equipped with a pocket just sufficiently large for receiving one golf ball.

4. The assembly of claim 3 wherein said pocket has a single mouth opening of elasticized nature extending in the width direction of said lower portion.

5. The assembly of claim 3 wherein said pocket includes an inner surface layer capable of carrying moisture and said lower portion is equipped with a moisture barrier backing to prevent passage of moisture from said pocket through said lower portion.

6. The assembly of claim 1 wherein said upper portion comprises a clip for attaching to a belt or a waist band, said clip having a first fastener element mounted thereon, said lower portion having a second fastener element mounted thereon for cooperative mating to said first fastener element for securing said lower portion to said clip, and said upper portion being equipped with a panel area for providing visual promotional information.

7. The assembly of claim 1 in combination with a golfer wearing pants having a waist band and a front pants pocket, wherein said upper portion of said golf towel assembly is attached to the golfer's pants at a location proximate to said waist band and said lower portion is in a depending relation to said upper portion, with at least a major portion of said lower portion stowed in said front pants pocket.

8. The assembly of claim 1 wherein said upper portion is integral with said lower portion, and said assembly has a generally triangular shape consisting of two lateral edges and said base edge, each said lateral edge being between about 25 centimeters and about 40 centimeters in length.

9. The assembly of claim 8 wherein said upper portion includes a slit therethrough in a direction parallel to the length direction of said lower portion, said slit having a length of at least about 2 centimeters and not more than about 6 centimeters.

10. The assembly of claim 9 in combination with a golfer wearing pants having a waist band and a front pants pocket, and a removable belt located about said waist band, wherein said upper portion of said golf towel assembly is in a substantially surrounding condition about said belt with said lower portion threaded through said slit and in a depending relation to said belt.

11. The combination of claim 10 wherein at least a major portion of said lower portion of said golf towel assembly is stowed in said front pants pocket.

12. The assembly of claim 1 combined as a kit with at least one oblong slip containing two or more golf balls.

13. The combination of claim 12 wherein said golf towel assembly is in a rolled configuration within said slip.

14. The combination of claim 12 further comprising a hanger sheet to which said slip is attached, said hanger sheet having an opening therethrough for receiving a display rack hook, and said golf ball towel assembly being fastened to said hanger sheet.

15. The combination of claim 12 further comprising an outer container, said outer container having at least three of said golf ball slips seated therein in a side by side configuration to form a substantially flat surface, said golf towel assembly being spread on said substantially flat surface, said outer container including a transparent window for viewing said towel assembly.

16. A method for preparing to clean a golf ball for putting, said method comprising the steps of:

a. equipping a golfer with pants having a waist band and a front pants pocket, b. providing a golf towel assembly satisfying the requirements of claim 1, c. attaching said upper portion of said towel assembly to said waist band of said golfer, d. tucking the major bulk portion of said lower portion of said golf towel assembly in said front pants pocket of said golfer to keep said lower portion from interfering with the golfer's swing and to allow quick removal of said lower portion for cleaning said golf ball, e. removing said lower portion from said front pants pocket, and f. cleaning said golf ball by wrapping and wiping said lower portion about said golf ball while retaining said upper portion attached to said waist band.

17. The method of claim 16 wherein said golf towel assembly is equipped with a slit through said upper portion thereof, and wherein said attachment of said upper portion to said waist band of said golfer comprises equipping said golfer with a removable belt around said waist band, tucking said golf towel assembly between said belt and said waist band, and threading said lower portion through said slit in said upper portion.

18. The method of claim 16 further comprising marking the location of a golf ball on a golf green with a ball marker and lifting the golf ball off of the putting green prior to cleaning the golf ball with said lower portion.

19. A golf ensemble comprising a golfer wearing pants having a waist band and front pants pocket in combination with a golf towel assembly comprising an upper portion attached to the golfer's front waist area and a depending lower portion for wiping debris from a golf ball, at least said lower portion being comprised essentially of a layer of terry cloth, said lower portion having a length and width and surface area, said length being in the direction depending from said upper portion and being at least about 15 centimeters and not more than about 25 centimeters, said width being in the direction transverse to said length and being at least about 10 centimeters and not more than about 20 centimeters, said surface area being at least about 150 square centimeters and not more than about 425 square centimeters and being of a shape sufficient to accommodate a circle having a diameter of at least about 10 centimeters so as to permit easy wrapping of said lower portion about a golf ball for cleaning, the major bulk portion of said lower portion being most distant from said upper portion and being created by the aforesaid characteristics for said length and width and surface area, said major bulk portion being stowed in said front pants pocket of said golfer to keep said depending lower portion from interfering with the golfer's swing and yet being quickly removable from the golfer's front pants pocket to permit use of said lower portion to clean a golf ball preliminary to putting while at all times retaining said golf towel assembly attached at its upper portion to the golfer's front waist area.

20. The ensemble of claim 19 wherein said lower portion of said golf towel assembly has a base edge at its end most distant from said upper portion, and said base edge is substantially perpendicular to said length and substantially parallel to said width, said base edge being substantially as wide as the widest part of said width.

21. The ensemble of claim 19 wherein said upper portion of said golf towel assembly comprises a strip of material extending from said lower portion, said strip of material having cooperative fastener parts mounted thereon in spaced relationship for attaching said upper portion about a belt or a belt loop.

22. The ensemble of claim 19 wherein said lower portion of said golf towel assembly is equipped with a pocket just sufficiently large for receiving one golf ball.

23. The ensemble of claim 22 wherein said pocket has a single mouth opening of elasticized nature extending in the width direction of said lower portion.

24. The ensemble of claim 22 wherein said pocket includes an inner surface layer capable of carrying moisture and said lower portion is equipped with a moisture barrier backing to prevent passage of moisture from said pocket through said lower portion.

25. The ensemble of claim 19 wherein said upper portion of said golf towel assembly comprises a clip for attachment to the golfer's front waist area, said clip having a first fastener element mounted thereon, said lower portion having a second fastener element mounted thereon for cooperative mating to said first fastener element for securing said lower portion to said clip, and said upper portion being equipped with a panel area for providing visual promotional information.

26. The ensemble of claim 19 wherein said upper portion of said golf towel assembly is integral with said lower portion, and said assembly has a generally triangular shape consisting of two lateral edges and a base edge, each said lateral edge being between about 25 centimeters and about 40 centimeters in length.

27. The ensemble of claim 26 wherein said upper portion of said golf towel assembly includes a slit therethrough in a direction parallel to the length direction of said lower portion, said slit having a length of at least about 2 centimeters and not more than about 6 centimeters.

28. The ensemble of claim 27 wherein the golfer is additionally wearing a removable belt located about said waist band, and wherein said upper portion of said golf towel assembly is in a substantially surrounding condition about said belt with said lower portion threaded through said slit and in a depending relation to said belt.

29. A method for preparing to clean a golf ball for putting, said method comprising the steps of:

a. equipping a golfer with pants having a waist band and a front pants pocket, b. providing a golf towel assembly for attachment to a golfer's front waist area for cleaning a golf ball, said golf towel assembly comprising:

an upper portion for attachment to a golfer's front waist area and a depending lower portion for wiping debris from a golf ball, at least said lower portion being comprised essentially of a layer of terry cloth, said lower portion having a length and width and surface area, said length being in the direction depending from said upper portion and being at least about 15 centimeters and not more than about 25 centimeters, said width being in the direction transverse to said length and being at least about 10 centimeters and not more than about 20 centimeters, said surface area being at least about 150 square centimeters and not more than about 425 square centimeters and being of a shape sufficient to accommodate a circle having a diameter of at least about 10 centimeters so as to permit easy wrapping of said lower portion about a golf ball for cleaning, said length and width and surface area being such that at least a major portion of said lower portion is easily stowed in a front pants pocket of a golfer to keep said depending lower portion from interfering with the golfer's swing and yet is quickly removed from the golfer's front pants pocket to permit use of said lower portion to clean a golf ball preliminary to putting while at all times retaining said golf towel assembly attached at its upper portion to the golfer's front waist area, c. attaching said upper portion of said towel assembly to said waist band of said golfer, d. tucking said lower portion of said golf towel assembly in said front pants pocket of said golfer to keep said lower portion from interfering with the golfer's swing and to allow quick removal of said lower portion for cleaning said golf ball, e. removing said lower portion from said front pants pocket, and f. cleaning said golf ball by wrapping and wiping said lower portion about said golf ball while retaining said upper portion attached to said waist band.

30. The method of claim 16 wherein said golf towel assembly is equipped with a slit through said upper portion thereof, and wherein said attachment of said upper portion to said waist band of said golfer comprises equipping said golfer with a removable belt around said waist band, tucking said golf towel assembly between said belt and said waist band, and threading said lower portion through said slit in said upper portion.

31. The method of claim 16 further comprising marking the location of the golf ball on a golf putting green with a ball marker and lifting the golf ball off of the putting green prior to cleaning the golf ball with said lower portion.

32. A golf towel for attachment to a golfer's front waist area for cleaning a golf ball, said golf towel comprising:

towel material in a triangular shape having two lateral edges of equal length which meet at an intersection, and a base edge connecting the ends of said lateral edges opposite said intersection, said lateral edges being between about 25 centimeters and 40 centimeters in length, said triangular shape having an upper portion proximate to said intersection through which a slit extends, and having a depending lower portion for wiping debris from a golf ball, said lower portion having a length and width and surface area, said length being in the direction depending from said upper portion and extending to said base edge, said width being in the direction transverse to said length and being at least about 10 centimeters and not more than about 20 centimeters at said base edge, and said surface area being at least about 150 square centimeters and not more than about 425 square centimeters and being of a shape sufficient to accommodate a circle having a diameter of at least about 10 centimeters so as to permit easy wrapping of said lower portion about a golf ball for cleaning, said length and width and surface area being such that at least a major portion of said lower portion is easily stowed in a front pants pocket of a golfer to keep said depending lower portion from interfering with the golfer's swing and yet is quickly removable from the golfer's front pants pocket to permit use of said lower portion to clean a golf ball preliminary to putting while at all times retaining said golf towel attached at its upper portion to the golfer's front waist area, and said slit in said upper portion being such as to receive through it said lower portion for the purpose of attaching said golf towel at the waist of a golfer.

* * * * *